US007196601B1

(12) United States Patent
Gottschalk

(10) Patent No.: US 7,196,601 B1
(45) Date of Patent: Mar. 27, 2007

(54) TEMPERATURE CORRECTION OF WIGGLERS AND UNDULATORS

(75) Inventor: Stephen C. Gottschalk, Woodinville, WA (US)

(73) Assignee: STI Optronics, Inc., Bellevue, WA (US)

( * ) Notice: Subject to any disclaimer, the term of this patent is extended or adjusted under 35 U.S.C. 154(b) by 109 days.

(21) Appl. No.: 10/657,640

(22) Filed: Sep. 8, 2003

Related U.S. Application Data

(60) Provisional application No. 60/409,291, filed on Sep. 6, 2002.

(51) Int. Cl.
*H01J 23/087* (2006.01)

(52) U.S. Cl. ..... 335/217; 335/296; 335/397; 335/306; 315/5.35; 372/2

(58) Field of Classification Search ..... 335/210, 335/306, 217; 315/3.14, 3.15; 372/2
See application file for complete search history.

(56) References Cited

U.S. PATENT DOCUMENTS 3,215,906 A * 11/1965 Taber ..... 335/210
3,227,913 A * 1/1966 Millward et al. ..... 315/3.5
4,539,512 A * 9/1985 Heynisch et al. ..... 315/5.35
4,839,059 A * 6/1989 Leupold ..... 335/210
5,010,640 A 4/1991 Gottschalk
5,103,200 A * 4/1992 Leupold ..... 335/217
6,573,817 B2 6/2003 Gottschalk

* cited by examiner

*Primary Examiner*—Ramon M. Barrera
(74) *Attorney, Agent, or Firm*—Christensen O'Connor; Johnson Kindness PLLC

(57) ABSTRACT

An undulator includes a periodic arrangement of magnets to produce a periodic spatial magnetic field distribution in a magnetic gap defined by the magnets. The undulator further includes a temperature-compensating material selectively arranged to compensate for a temperature-dependent change in the magnetic field of the undulator. The change may be in the strength of the magnetic field, or in the position of the magnetic field centerline. According to one aspect of the invention, the temperature-compensating material is movably arranged, so as to fine tune its compensation effect after it is initially arranged. Alternatively or additionally, the amount of temperature-compensating material may be adjusted to fine tune its compensation effect after it is initially arranged.

35 Claims, 17 Drawing Sheets

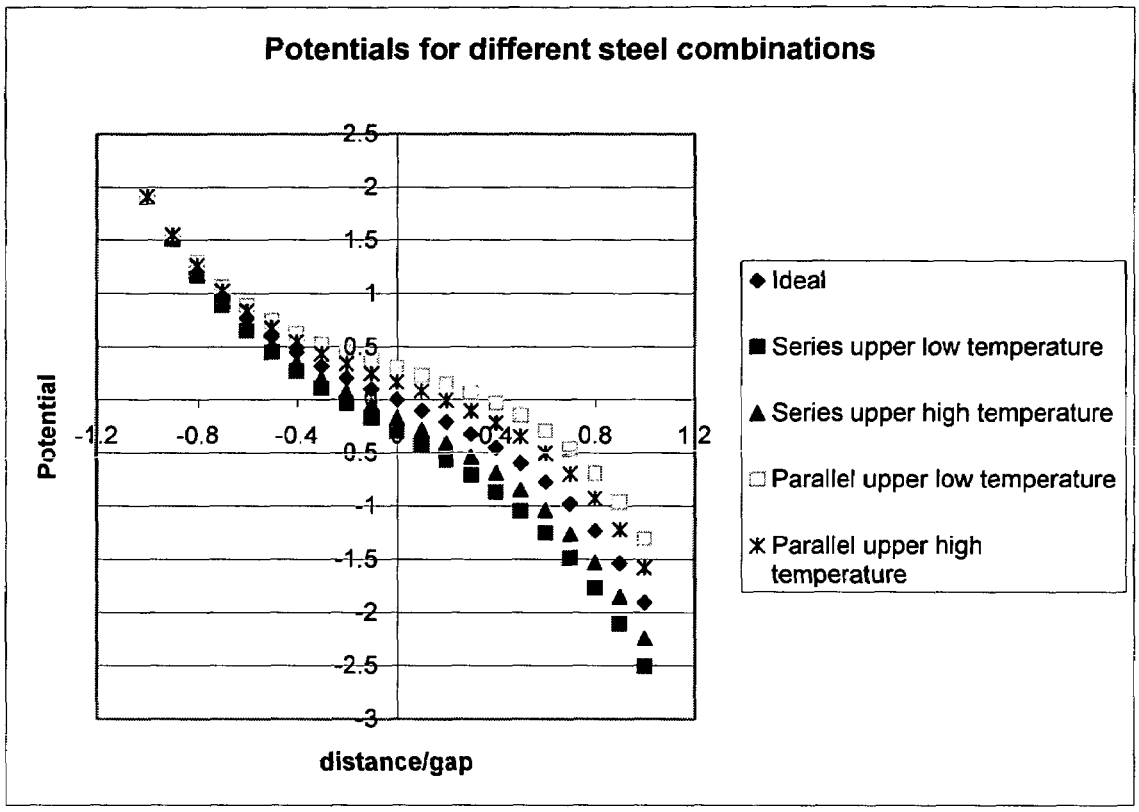
*FIGURE 1* D

TEMPERATURE CORRECTION OF WIGGLERS AND UNDULATORS

CROSS-REFERENCE TO RELATED APPLICATION

This application claims the benefit of U.S. Provisional Application No. 60/409,291, filed Sep. 6, 2002.

FIELD OF THE INVENTION

The invention is directed generally to wigglers and undulators, and more specifically to means for compensating for the magnetic field strength change and/or the magnetic centerline shift in the wigglers and undulators due to temperature variations.

BACKGROUND OF THE INVENTION

Wigglers and undulators are magnetic assemblies used in synchrotron radiation (SR) sources and free electron lasers (FEL's). An exploded view of a wiggler/undulator can be found in FIG. 10. The terms wiggler and undulator are used interchangeably, and in the present application the term undulator is used to refer to both. Briefly, an undulator consists of a pair of opposing magnet arrays, which create an oscillating magnetic field in the gap separating the arrays (i.e., the gap between the arrays). A high-energy electron beam passing through this gap parallel to the arrays will wiggle back and forth in its trajectory because of the periodic magnetic field. Some undulators also include poles to be coupled to the magnets, respectively. The structure and operation of an undulator are known in the art (see, for example, U.S. Pat. No. 5,010,640), and undulators are commercially available from STI Optronics of Bellevue, Wash.

Undulators are periodic magnetic structures, and their magnetic field is essentially sinusoidal. Many undulators have a fixed field direction, and these are called linearly polarized undulators. Some undulators known as elliptically polarized undulators have an adjustable field direction. Some other undulators have a magnetic field direction that rotates. These are known as helical undulators. The temperature compensation method of the present invention can be used with all types of undulators, specifically including these three types.

For a variety of mechanical and magnetic reasons, the strength and centerline of the magnetic field in the gap in an undulator can vary with temperature. This is true for both permanent magnet undulators and electromagnet undulators. In permanent magnet undulators, there is a multitude of individual magnets. The strength of these magnets can vary with temperature, which will directly impact the field strength of the undulator. For example, the strength (or flux production) of Neodymium Iron Boron (NdFeB) magnets vary by −0.1%/C.° and the strength of ceramic ferrites vary by −0.2%/C.°, both near room temperature. As linearly polarized undulators, both permanent magnet undulators and electromagnetic undulators have upper and lower assemblies. If an undulator uses steel poles, the poles will expand as the temperature increases, which will change the gap spacing between the upper and lower assemblies. The gap change causes the field strength of the undulator to vary.

Likewise, the mechanical structure that holds the entire undulator will expand or contract with temperature. This will again change the magnetic gap (between the magnet arrays), which leads to a field strength change. Further, if only a portion of the mechanical structure that holds the undulator expands as the temperature increases, this will shift (e.g., raise) the magnetic centerline.

These temperature dependencies can cause unacceptable performance variations of the FEL or SR source. When this occurs, there is a need to correct for the strength variations or the centerline shifts so as to restore the performance.

The prior methods for addressing the temperature dependencies consisted of using entirely mechanical means. For example, in one prior method, when the center of the arrays of magnets moves due to thermal expansion, a mechanical mover is used to move the entire undulator up or down to compensate for the change. This is quite difficult as undulators can weigh several tons and be several meters long. In addition, many applications require micron level control of the movement, so the apparatus usually needs high accuracy and precision. Yet, the motors and electronics required to achieve high accuracy and precision can be exposed to high radiation levels in the undulator's operating environment, and this radiation can easily cause failure of the motors and/or electronics. Radiation resistant equipment can be very expensive and complex, and not always available.

In another prior method, a mechanical structure that holds the undulator is made of specially chosen but dissimilar materials. This is done so that the relative rates of thermal expansion among the dissimilar materials would correct for the temperature effects. In one example, when the temperature increases, the magnetic strength decreases, so the mechanical apparatus is designed to decrease the mechanical spacing between the two assemblies (halves) of the undulator as the temperature increases. This increases the magnetic field at the gap between the two assemblies to compensate for the reduction in the magnet strength. The prior method used titanium, aluminum, and steel. Titanium is very expensive, difficult to machine, and has mechanical creep over time. In addition, since the differences in the thermal expansion coefficients for the different materials are large, there are many induced stresses in the mechanical structure. These lead to deformations, lack of predictability, stiction, twist, warp, and other mechanical problems. Engineering solutions to these problems are challenging and do not always work. This means that there can still be residual field strength and centerline shifts that will need to be corrected. In short, this prior method is complex, expensive, hard to engineer, and furthermore, has no means of correcting for design deficiencies. Either this approach would work, or the entire design would need to be changed and iterated to make it work, and yet this process may not converge due to the inherent complexity of the approach.

SUMMARY OF THE INVENTION

The present invention proposes a novel method of temperature compensation, which is simple, inexpensive, can adjust both field strength variations and centerline shifts due to temperature fluctuations, and can be used with all types of undulators. Furthermore, the present method is continuously tunable, iterative, and convergent. Unlike the prior methods that consisted of using entirely mechanical means to correct for temperature variations, the present invention is directed to providing magnetic means to correct for the temperature variations.

Specifically, in one embodiment, an undulator of the present invention includes a periodic arrangement of magnets to produce a periodic spatial magnetic field distribution in a magnetic gap defined by the magnets. The magnets are supported by a support structure. The undulator further includes a temperature-compensating material selectively arranged to compensate for a temperature-dependent change in the magnetic field of the undulator.

According to one aspect of the invention, the temperature-compensating material is movably arranged, so as to fine tune its compensation effect after it is initially arranged. Alternatively or additionally, the amount of temperature-compensating material may be adjusted to fine tune its compensation effect after it is initially arranged.

According to another aspect, the temperature-compensating material is arranged to compensate for a temperature-dependent change in the strength of the magnetic field. In one embodiment, the temperature-compensating material is arranged in a parallel flux shunting configuration to render the magnetic field strength independent of a temperature variation over a predefined range. In another embodiment, the temperature-compensating material is arranged in a parallel plus series flux shunting configuration, and the contribution from the parallel shunting is stronger than the contribution from the series shunting so that the magnetic field strength is independent of a temperature variation over a predefined range. The temperature-compensating material may be arranged in a variety of locations, such as on the front surfaces of the magnets facing the magnetic gap, on the back surfaces of the magnets away from the magnetic gap, on or in poles that are arranged relative to the magnets, or on or in any structure supporting the magnets (and poles).

According to yet another aspect, the temperature-compensating material is arranged to compensate for a temperature-dependent shift of the position of the magnetic field centerline. In one embodiment, the temperature-compensating material is arranged in a parallel flux shunting configuration to render the position of the magnetic field centerline independent of a temperature variation over a predefined range. In another embodiment, the temperature-compensating material is arranged in a parallel plus series flux shunting configuration, and the contribution from the parallel shunting is stronger than the contribution from the series shunting so that the position of the magnetic centerline is independent of a temperature variation over a predefined range. Basically, the centerline compensation is achieved by placing different amounts of temperature-compensating materials on opposing arrays of magnets, poles, and/or support structures.

According to still another aspect, the temperature-compensating material is associated with end magnets that are placed on horizontal ends of an array of the magnets. This arrangement is advantageous in compensating for the temperature-dependent steering of an electron beam passing through the undulator.

The present invention further provides a method of correcting for a temperature-dependent change in an undulator. As before, the undulator includes a periodic arrangement of magnets to produce a periodic spatial magnetic field distribution in a magnetic gap defined by the magnets. The method includes the step of selectively arranging temperature-compensating material in the undulator so as to compensate for a temperature-dependent change in the magnetic field.

According to one aspect of the invention, the method further includes the step of moving the temperature-compensating material to fine tune its compensation effect after it is initially arranged in the undulator. According to another aspect, the method further includes the step of varying the amount of the temperature-compensating material to fine tune its compensation effect after it is initially arranged in the undulator. The temperature-dependent change to be compensated for may be a change in the strength of the magnetic field and/or a change in the position of the magnetic field centerline.

According to yet another aspect of the present method, the temperature-compensating material is applied to be associated with only a subset of the magnets, wherein the subset means one or more magnets less than the entire magnets. This method is effective in producing a local temperature-dependent variation to compensate for a temperature-dependent local change in the magnetic field. According to still another aspect, the temperature-compensating material may be specifically shaped so as to additionally achieve the shimming effect of tuning the magnetic field to correct for temperature-dependent field errors.

The present invention also provides an undulator, wherein a temperature-compensating material is arranged to render the magnetic field strongly dependent on a temperature variation over a predefined range. This arrangement is useful in providing a temperature-tunable undulator, i.e., an undulator whose magnetic characteristics can be varied by changing its operating temperature. According to one embodiment, the temperature-compensating material is arranged in a series flux shunting configuration. In another embodiment, the temperature-compensating material is in a parallel plus series flux shunting configuration, and the contribution from the series shunting is stronger than the contribution from the parallel shunting. As before, the temperature-compensating material may be placed on a variety of locations, such as on side surfaces of the magnets, on or in poles associated with the magnets, or between the magnet and the corresponding pole.

BRIEF DESCRIPTION OF THE DRAWINGS

The foregoing aspects and many of the attendant advantages of this invention will become more readily appreciated as the same become better understood by reference to drawings, wherein:

FIG. 1D is a graph showing magnetic scalar potentials for different arrangements of compensating materials;

DETAILED DESCRIPTION OF THE PREFERRED EMBODIMENT

The present method uses special materials, typically steels, with temperature-dependent magnetic properties, to correct for temperature-dependent field changes such as field strength variations and centerline shifts. The materials may be any suitable ferromagnetic materials having a low Curie temperature, at which it turns from ferromagnetic to paramagnetic. Their permeability decreases with increasing temperature essentially linearly over a predefined temperature range. Specifically, temperature-compensating steels that have about 30–34% Nickel and a low Curie temperature may be used (Carpenter temperature compensator 30 alloy, having a linear magnetic permeability between 5C.° and 50C.°, etc.).

Some special cases are first described below, followed by the description of a more general approach. Particularly, specific analytical examples using a linearly polarized undulator will be discussed first, which demonstrate the validity of the approach. This qualitative discussion is later quantified, and finally followed by the illustration of some specific embodiments of the invention.

Qualitative Discussion of the Method

Figure 1A:
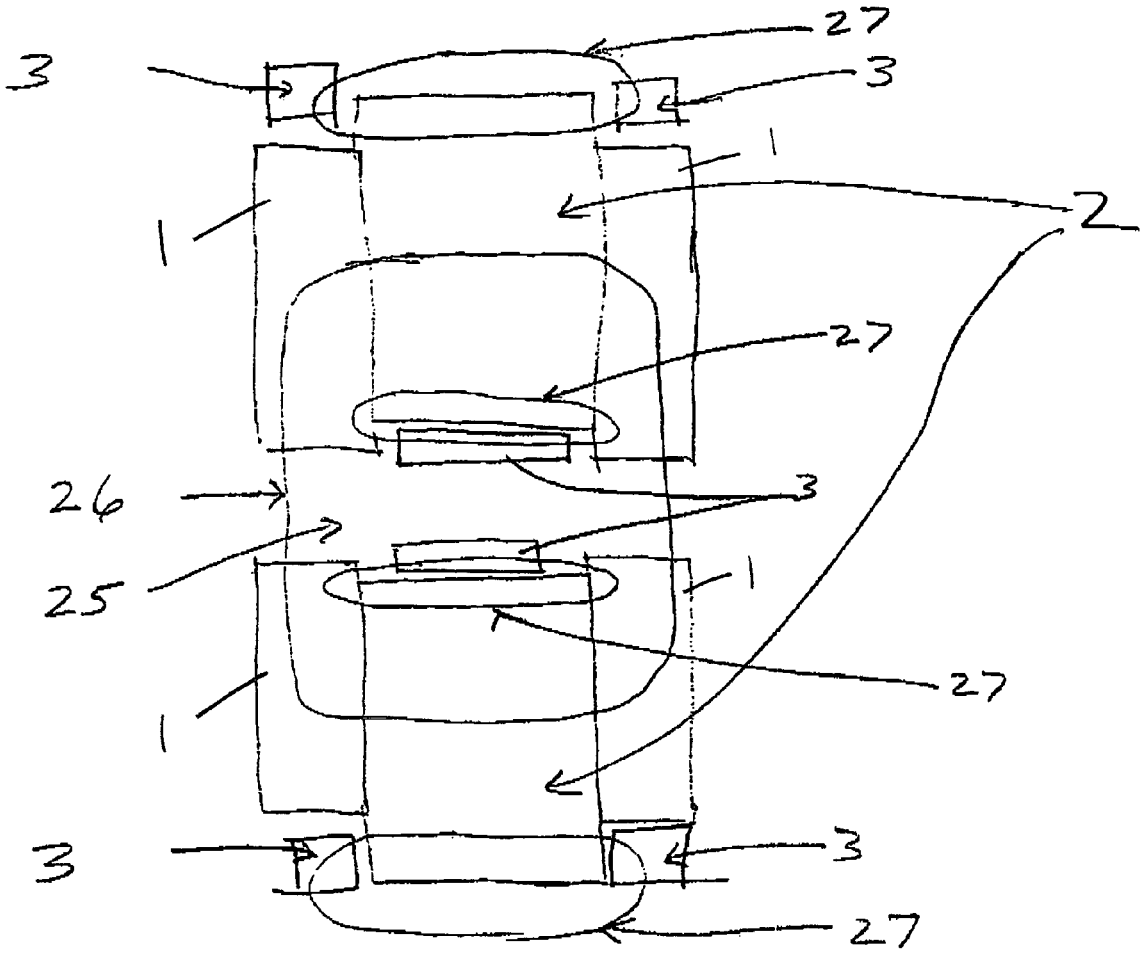
FIG. 1A is a diagram illustrating the concept of parallel flux shunting configuration.

If the undulator's field strength decreases with increasing temperature, the temperature-compensating steels are used in a parallel flux shunting configuration. This means that the magnetic field is shared between the temperature-compensating steel magnetic circuit and the main undulator magnetic circuit. FIG. 1A illustrates magnets 2, poles 1, and temperature-compensating materials 3 (or "compensators") arranged in a parallel flux shunting configuration. At low temperatures, each of the permanent magnets 2 is stronger and thus could supply more flux 26 in the magnetic gap 25 than at high temperatures, but the compensating material 3 has a high permeability so it shunts (or diverts) a larger fraction of the flux 27 away from the magnetic gap 25 than it does at high temperatures. On the other hand, at high temperatures, the permanent magnet 2 is weaker (supplying less flux) but the compensating materials' permeability is low so it shunts less flux away from the magnetic field in the gap 25. Therefore, at low temperatures, the compensating material 3 reduces the relatively strong magnetic field, while at high temperatures, the compensating material 3 does not decrease the relatively weak magnetic field as much. Consequently, by choosing the right shape and location for the compensating material 3, these two effects (i.e., the change in the temperature compensator's magnetic circuit and the change in the undulator magnet's magnetic circuit) can be made to cancel each other, so as to maintain the field strength (i.e., the flux density) essentially constant near the magnetic gap 25 regardless of changes in the ambient temperature.

Figure 1B:
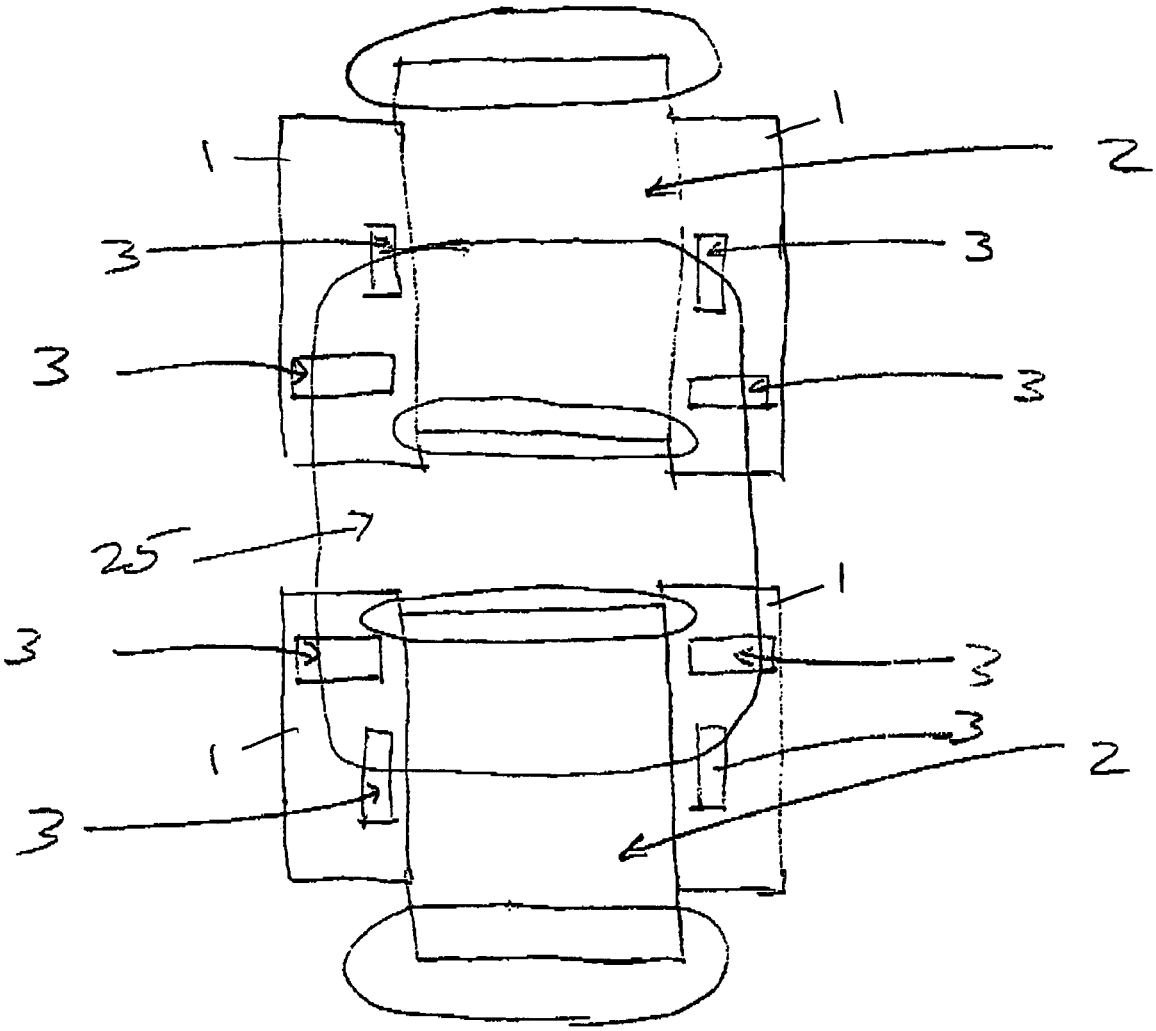
FIG. 1B is a diagram illustrating the concept of series flux shunting configuration.

If the undulator's field strength increases with increasing temperature, the compensating material is used in a series flux shunting configuration. One way that this could occur is if the upper and lower assemblies of an undulator expand. The spacing between the two assemblies would get smaller, and thus the magnetic field strength would increase with increasing temperature. As mentioned before, this can occur in an electromagnetic undulator as well as in a permanent magnet undulator. FIG. 1B illustrates magnets 2, poles 1, and compensators 3 arranged in a series flux shunting configuration. When the compensator 3 is used in this configuration, at low temperatures, the compensator 3 will increase the effective permeability of the undulator's magnetic circuit, which leads to an increase in the magnetic field strength near the gap 25. On the other hand, at high temperatures, the compensating steel's permeability decreases and it acts like an additional air space provided in the undulator's magnetic circuit, which reduces the magnetic field strength near the gap 25. Consequently, the compensator 3 in a series flux shunting configuration functions to maintain the field strength (i.e., the flux density) essentially constant near the magnetic gap 25 regardless of changes in the ambient temperature.

Therefore, by choosing the correct location, amount, and configuration of temperature-compensating steel, either an increasing or decreasing undulator magnetic field strength can be corrected.

Furthermore, the temperature-compensating material may be applied to correct for any temperature-dependent magnetic centerline shifts, also. In undulators, there are two centerlines: a mechanical centerline (see 22 in FIG. 11) and a magnetic centerline. The mechanical centerline can be determined by a variety of methods, such as surveying. Once a mechanical centerline is defined, the magnetic centerline can be found. In a linearly polarized undulator, the magnetic field increases in the direction towards the two opposing poles (or upper and lower assemblies). The field is essentially symmetric about the magnetic centerline and it is a minimum at the magnetic centerline. Thus, magnetic field measurements can be used to find the minimum field location to determine the magnetic centerline. For other types of undulators also, magnetic field measurements can be used to determine the magnetic centerline. While the location of the magnetic centerline may vary throughout the length of the undulator, in the following discussion, it is treated as being constant. As the temperature is changed, both the mechanical and magnetic centerlines move. Furthermore, in principle, they may even vary amongst different undulators of the same design. Undulators, however, use an electron beam to create radiation. The center of the electron beam must be aligned to the magnetic centerline, and thus it is desirable to maintain the magnetic centerline constant.

The method used to correct for temperature dependent centerline shifts is to weaken or strengthen the magnetic field on the upper or lower magnet assembly (comprising magnets, or a combination of magnets and poles) in a temperature dependent manner.

Figure 1C:
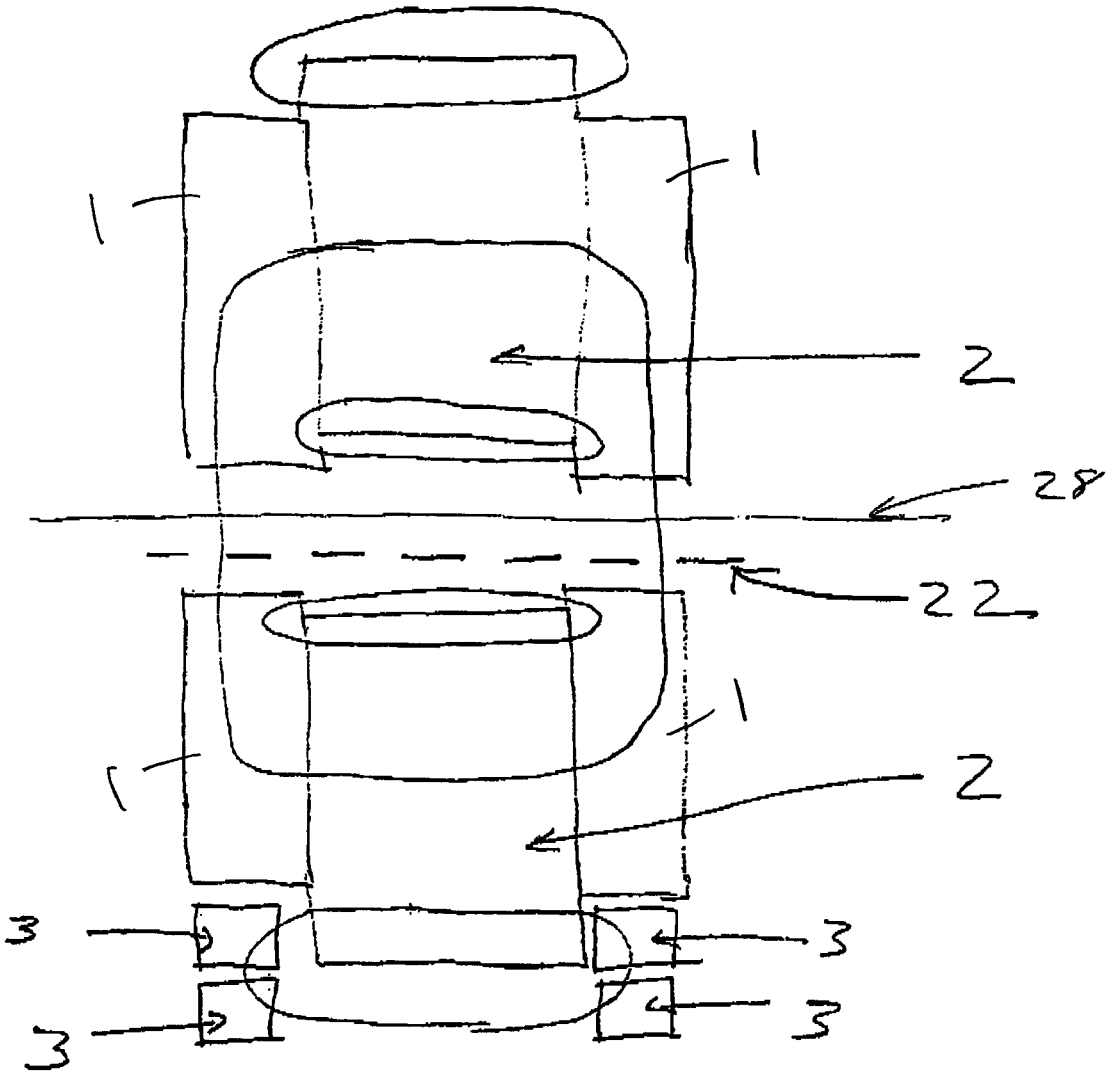
FIG. 1C is a diagram illustrating a method of compensating for a temperature-dependent magnetic centerline shift.

Referring to FIG. 1C, the simplest case is when essentially equal amounts of compensating steel have already been added to the upper and lower magnets 2, both in a parallel flux shunt configuration, to remove the temperature dependence of the undulator's field strength. If some or all of the compensating material 3 is removed from the upper magnet and added (i.e., moved) to the lower, as illustrated, then the upper magnet becomes stronger by a small amount (because the flux-shunting compensating material is removed) and the lower magnet becomes weaker by the same amount (because the flux-shunting compensating material is added). This will not affect the magnetic field strength because the average amount of the temperature-compensating material per magnet (i.e., the total amount of the temperature-compensating material divided by the number of the magnets to which the material is magnetically coupled) remains unchanged, as should be apparent to one skilled in the art. However, moving a temperature-compensating material from the upper magnet to the lower magnet will move the magnetic centerline 28 down toward the lower magnet, because the lower magnet has more flux-shunting compensating material 3 and thus is weaker than the upper magnet. Thus, if the magnetic centerline initially coincided with the mechanical centerline 22, this will create an offset between the two. However, as the temperature increases, the compensating material has a smaller effect (shunting less flux). This means that, with temperature increase, the strength difference between the upper and lower magnets becomes smaller, and as a result, the magnetic centerline 28 starts to move upward. Thus, this configuration is effective in correcting for a downward shift of the magnetic centerline 28 due to temperature increase.

Essentially, by arranging different amounts of temperature-compensating materials on opposing magnets (or poles), a centerline shift in the direction connecting the opposing magnets can be compensated. With proper choice of the temperature-compensating material, its dimensions and location, the magnetic centerline can be maintained at an essentially constant location despite changes in the operating temperature. Also, note that as long as the average compensating material amount for each magnet remains the same, the magnetic field strength will be independent of temperature while the centerline will move linearly with temperature.

If necessary, the downward magnetic centerline offset (that occurs due to applying more temperature-compensating material to the lower magnet assembly than the upper magnet assembly, regardless of the temperature) can be removed by preloading both the upper and lower magnet assemblies with standard steel in a parallel flux shunt configuration. Since standard steels have essentially no temperature dependence, they will simply reduce the magnetic field. If standard steel is removed from the lower magnet assembly and added to the upper magnet assembly, then the upper magnet assembly will become weaker and the lower stronger. This will shift the magnetic centerline upward in a temperature independent manner. Therefore, moving a temperature-compensating material from the upper magnet assembly to the lower magnet assembly while moving standard steel from the lower magnet assembly to the upper magnet assembly will prevent the magnetic centerline offset from the mechanical centerline, and at the same time achieve the desired temperature-dependent upward shift of the centerline to compensate for the temperature-dependent downward shift of the centerline.

Conversely, following the above example, if the standard steel and the compensating material are used in a series flux shunting configuration, the magnetic centerline will have a downward temperature dependence (i.e., shifting downwardly with increasing temperature).

Still following the above example, if the roles of the upper and lower magnet assemblies in the parallel flux shunt configuration are reversed, then the magnetic centerline will have a downward temperature dependence.

Likewise, reversing the roles of the upper and lower magnet assemblies in the series flux shunt configuration, described above, will result in the magnetic centerline having an upward temperature dependence.

As discussed above, in generally all types of undulators, both the magnetic centerline and the field strength vary with temperature. The variation will also differ among plural undulators having the same nominal design. Thus, there is a need to generalize the method proposed in the present invention. A particularly useful design approach is based on the magnetic scalar potential. Adding a compensating material modifies the scalar potential boundary conditions (at the magnet assemblies or at the "poles"). This will then produce a change in the field strength and/or the centerline. The method will be illustrated for a linearly polarized undulator, but it is generally applicable to other undulator designs.

Any magnetostatic field can be written as the gradient of a magnetic scalar potential $\Phi$:

$$B=-\nabla\Phi$$

For an ideal linearly polarized undulator the form for $\Phi$ is $$\lambda_w=\text{undulator period}$$

$$k_w=2\pi/\lambda_w$$

$$\Phi=-B_0\frac{\sinh(k_w y)}{k_w}\cos(k_w z)$$

$$B_y=B_0\cosh(k_w y)\cos(k_w z)$$

$$B_z=-B_0\sinh(k_w y)\sin(k_w z)$$

The magnetic centerline is the y value at which the potential is zero for all values of z. The magnetic gap of the undulator corresponds to y=−g/2 and y=g/2. If the undulator has a slowly varying gap, g(z), the magnetic field will vary. A useful relationship is the well known Halbach scaling law:

$$\overline{B}=\text{const}B_r$$

$$B_0(z)=\overline{B}\exp(-\pi g(z)/\lambda_w)$$

$$B_r=\text{magnet remanence}$$

Note that this is an approximation that is only valid when dg/dz is small. The potential at the "poles", i.e. when z=0, $\lambda_w/2$, $\lambda_w$, $3\lambda_w/2$, etc. is:

$$\Phi_{upper}=\pm B_0(z)\sinh(k_w g(z)/2)/k_w$$

$$\Phi_{lower}=\pm B_0(z)\sinh(k_w g(z)/2)k_w$$

$$2V\equiv\Phi_{upper}-\Phi_{lower}=-2B_0(z)\sinh(k_w g(z)/2)$$

The potential difference between the poles is defined to be 2 V. It is an indication of the magnetic field strength. If an upper pole is stronger, then $\Phi_{upper}$ increases in magnitude. This shifts the zero value of the potential, shifting the centerline, and also increases the potential difference between the poles, changing the magnetic field strength. When this effect occurs due to temperature changes, the magnetic centerline and field strength become temperature dependent. Operationally, the entire temperature dependence can be described as being equivalent to temperature dependent pole potentials. Compensating steels modify the temperature dependence of the potentials. Since compensating steels can be applied throughout the length of the undulator, they can be used to modify pole-by-pole temperature dependencies.

Quantitative Discussion of the Method

Now, the previous qualitative discussion of how compensating materials arranged in series or parallel flux configurations operate is quantified, to show how these compensating materials can be used to correct these scalar potential variations with temperature. Referring to FIG. 1D, the ideal case is labeled as ♦. The ideal case corresponds to adding standard steel in a series circuit. This makes the pole stronger, i.e. increasing the potential. If the steel is added in a parallel circuit configuration, then it shunts flux and makes the pole weaker, i.e. decreasing the potential. If all effects are temperature independent, potential differences can be corrected by choosing the appropriate series or parallel steel combinations. This is one way to shim an undulator. However, this approach (using standard steel) does not correct temperature dependencies. So, according to the present invention, compensating steels are added, and four different arrangements of compensating materials are shown in FIG. 1D (arranged on the upper magnet assembly in series at low temperatures; arranged on the upper magnet assembly in series at high temperatures; arranged on the upper magnet assembly in parallel at low temperatures; and arranged on the upper magnet assembly in parallel at high temperatures). When the temperature increases, the series compensating material having a decreasing permeability has a weakening effect, i.e. dB/dT is negative and the zero potential moves toward the pole that has the compensating material (i.e., upwardly). A parallel compensating material shunts less flux at higher temperatures, so it produces a stronger pole, i.e. it has a positive dB/dT and the zero potential moves away from the pole that has the compensating material (i.e., downwardly). In the examples of FIG. 1D, adding a series compensating material to the upper pole moves the centerline in the same direction (i.e., upwardly) as adding a parallel compensating material to the lower pole.

While the series and parallel configurations have been described separately, it should be apparent to one skilled in the art that both series and parallel configurations may be combined in some applications, wherein the contribution from one configuration may be more or less than the configuration from the other configuration to achieve the desired effects.

In general, the effect of adding compensating steel will depend on its grade, location, and shape and amount. Basically, the temperature dependence of its permeability depends on the amount of Nickel, which essentially defines the operating range of temperatures (over which the permeability changes linearly). In some applications, different grades of temperature-compensating materials may be used in combination to achieve the desired effects. Also, it should be apparent that the compensating materials do not need to be made from single pieces. They could be made from several thinner pieces or from physically distinct pieces to allow room for clamping or other features. The temperature-compensating material can be arranged in various locations as long as the material is magnetically coupled to the undulator's magnet(s) including, but not limited to, the front, back, and side surfaces of the magnets and/or poles, between a magnet and a pole, or even on or in any structures (including clamps, brackets, etc.) supporting the magnets and poles. Various examples will be illustrated below and described in detail. The particular location of the temperature-compensating material will be dictated by the structural limitations and the desired compensating effects of each application. The shape of a compensating material may be advantageously configured so that the material will also serve as a shim to correct for any field errors, as will be also described later.

Those skilled in the art will understand that the end magnets (see 2*c* in FIG. 12) of an undulator have significantly different leakage flux paths as compared to the rest of the magnets. Nonetheless, the general concepts of series and parallel shunting to correct or modify the temperature dependence of the magnetic field are applicable. In particular, end magnets' leakage paths could steer the electron beam passing through the undulator (i.e., impart an angle to the electron beam) in a temperature dependent manner. With the use of the temperature-compensating material, temperature-dependent end-field-induced angular dependencies of an electron beam can be compensated.

The effect of adding compensating material of a certain grade, shape, and amount, at a certain location can be known by analysis and/or experiments. The compensating material provides means for adjusting the magnitude of dB/dT as well as the magnitude of d(centerline)/dT. Removing a compensating material has the opposite effect to adding it. As will be apparent to one skilled in the art, there are a large number of ways to add a compensating material to magnets or poles (or to or in support structures) in any suitable manner. They can be attached temporarily by magnetic force or using clamps, etc. or permanently using adhesives, or in other ways as will be apparent to one skilled in the art. Note that they can be attached, temporarily or permanently, only to a subset (e.g., one) of the array of magnets (or poles) to compensate for a local temperature-dependent variation in the field strength or centerline. Furthermore, it is possible to arrange a compensating material in a movable manner so that its locating can be adjusted to let more or less magnetic field pass through the compensating material. This approach, in addition to changing the amount of the compensating material after it is initially arranged, is advantageous in fine tuning the compensating effects of the material. These and other advantages of the present invention will be more fully described in the following examples.

EXAMPLES

Figure 2:
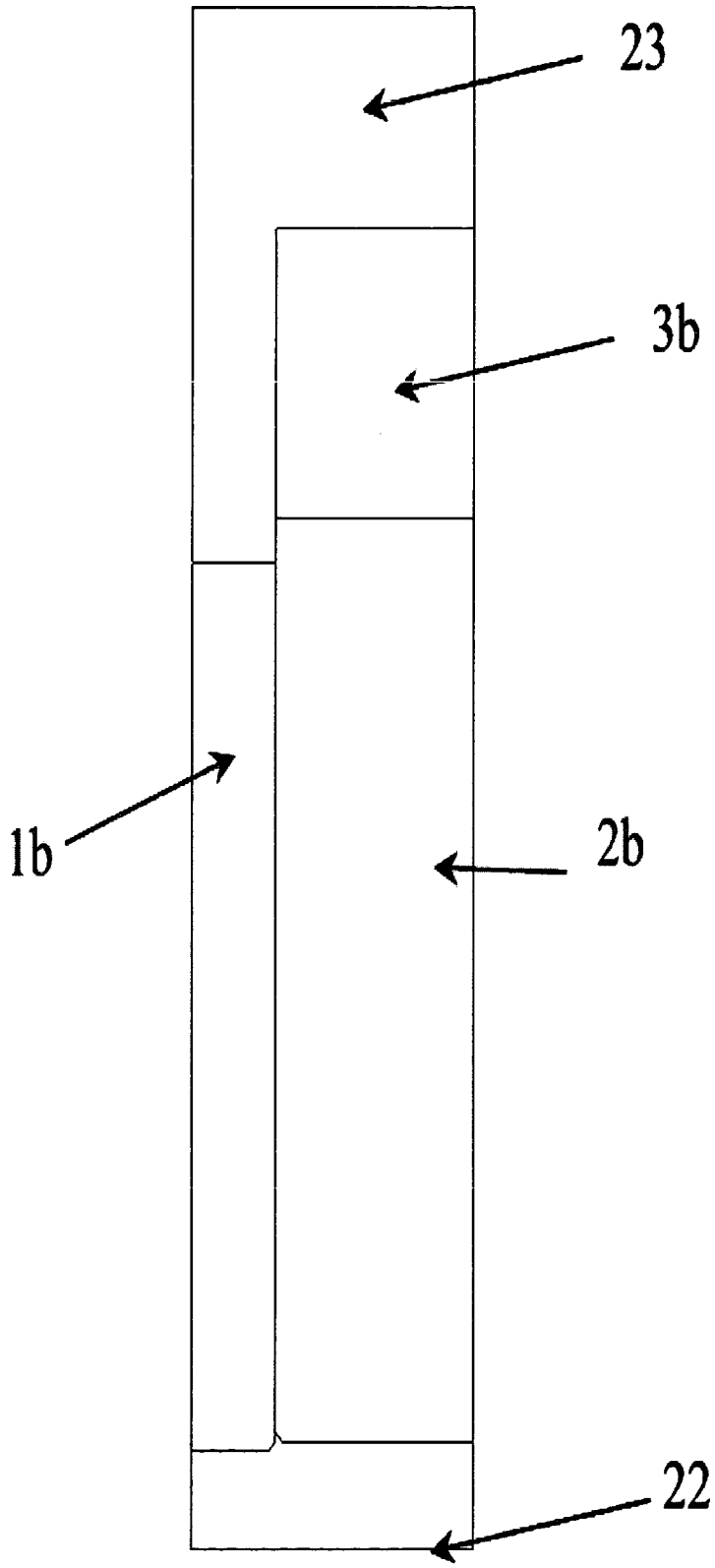
FIG. 2 illustrates a quarter-period cell of an undulator showing temperature-compensating steel in a parallel flux shunting configuration.
Figure 8:
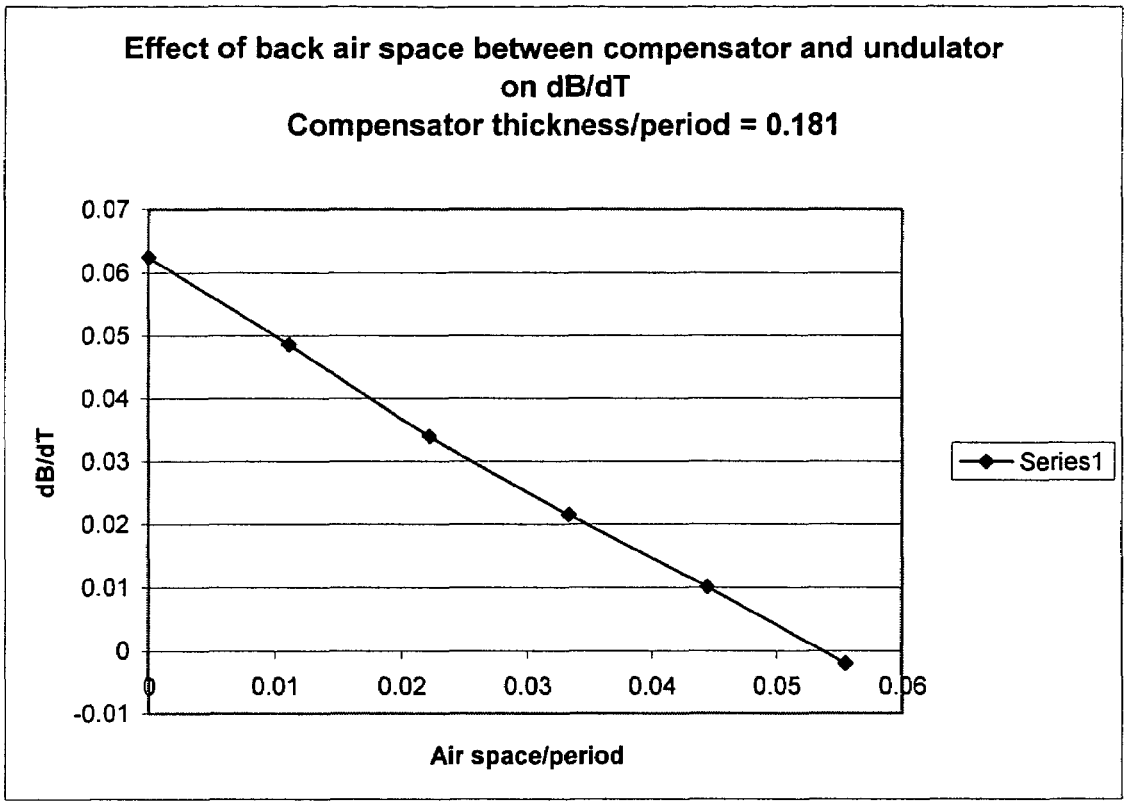
FIG. 8 is a graph showing the effect of a "back" air space provided between temperature-compensating material and an undulator magnet on dB/dT.
Figure 9:
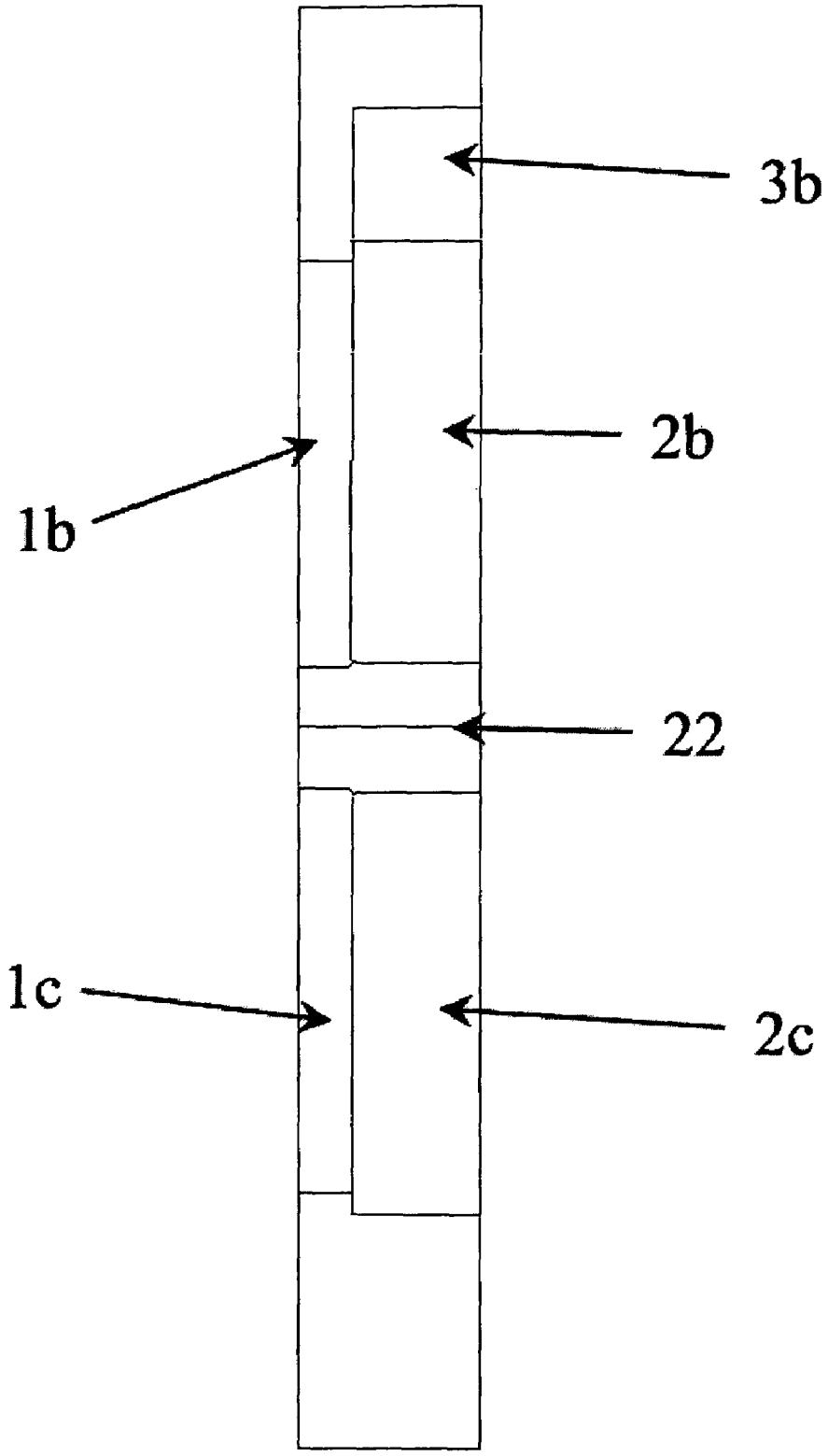
FIG. 9 is a sample temperature-compensating material arrangement for adjusting a magnetic centerline.
Figure 10:
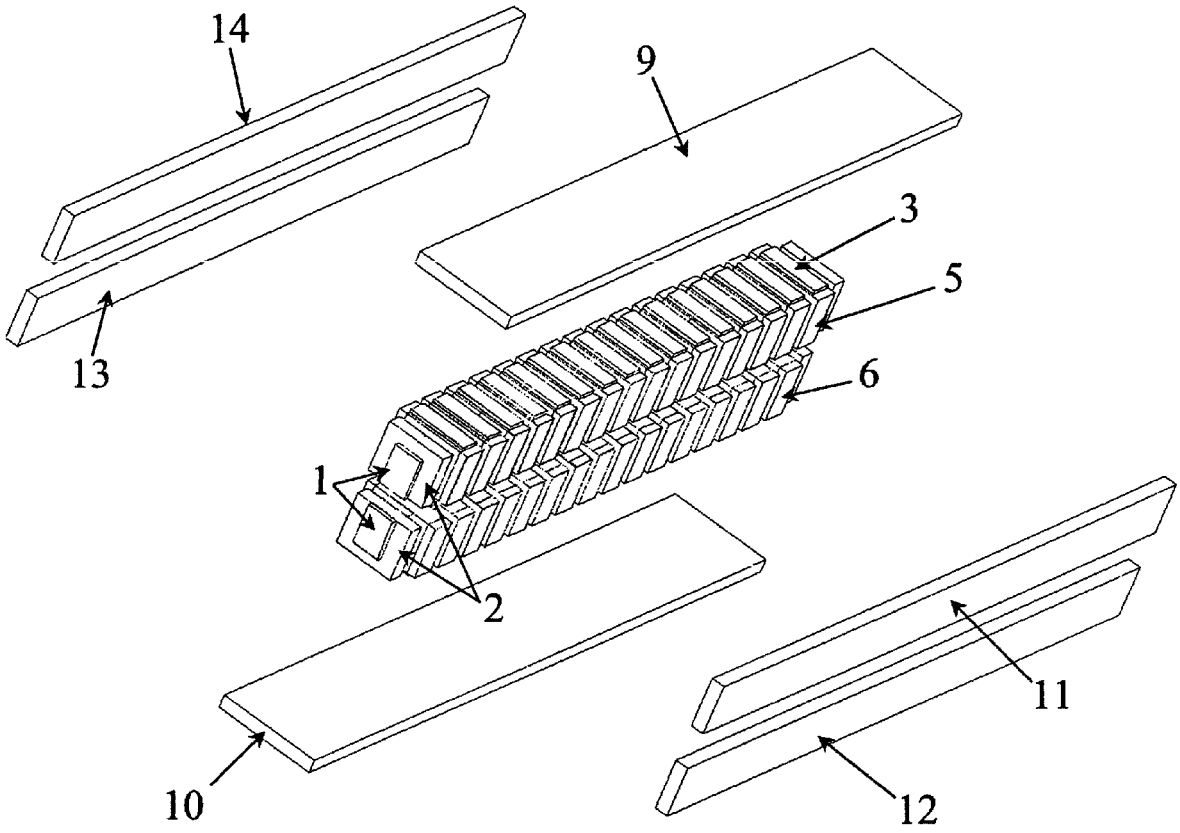
FIG. 10 is an exploded view of an undulator including opposing arrays of magnets and poles, wherein each magnet is provided with one "back" and two "side" compensators.

Some examples are shown in reference to FIGS. 2–9 to illustrate the use of compensating materials to adjust for dB/dT and d(centerline)/dT. In these figures, the compensating materials are in a parallel flux shunt configuration. The analysis method is finite element analysis (FEA). The magnetic model is shown in FIG. 2, illustrating a half pole 1*b* (i.e., half of the pole as seen along the direction of the undulator as shown in FIG. 10) coupled to a half magnet 2*b*. Toward the "back" 23 of the half magnet 2*b*, i.e., the side away from the mechanical centerline 22 of the undulator, a half compensating material 3*b* is arranged. Boundary conditions are used to provide a periodic magnetic field. The FEA is two dimensional, but the principles are easily extended to three dimensions, and three-dimensional embodiments will be explicitly described in reference to FIGS. 10–14 later.

Figure 3:
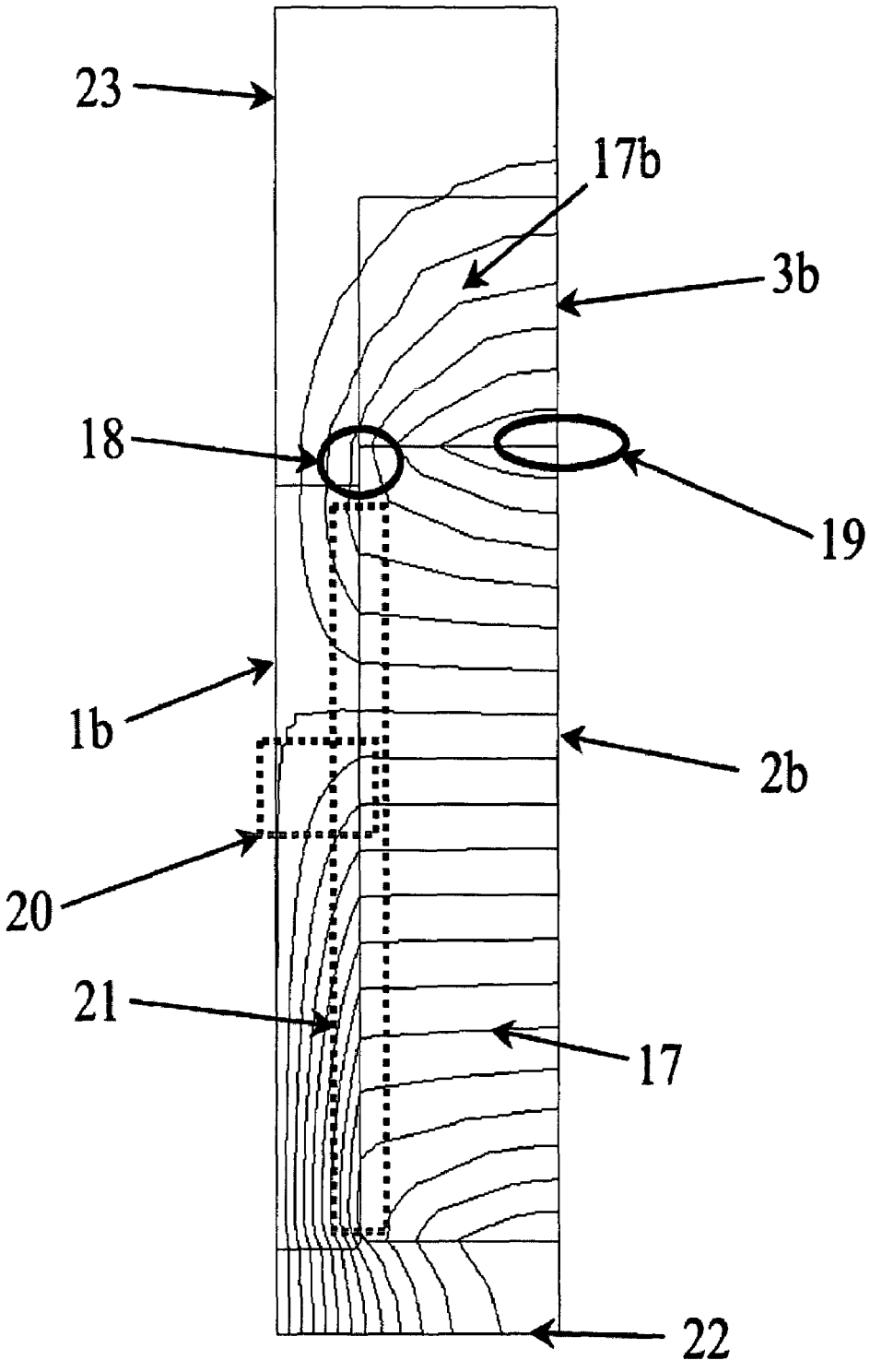
FIG. 3 illustrates flux paths in the undulator cell of FIG. 2.
Figure 4:
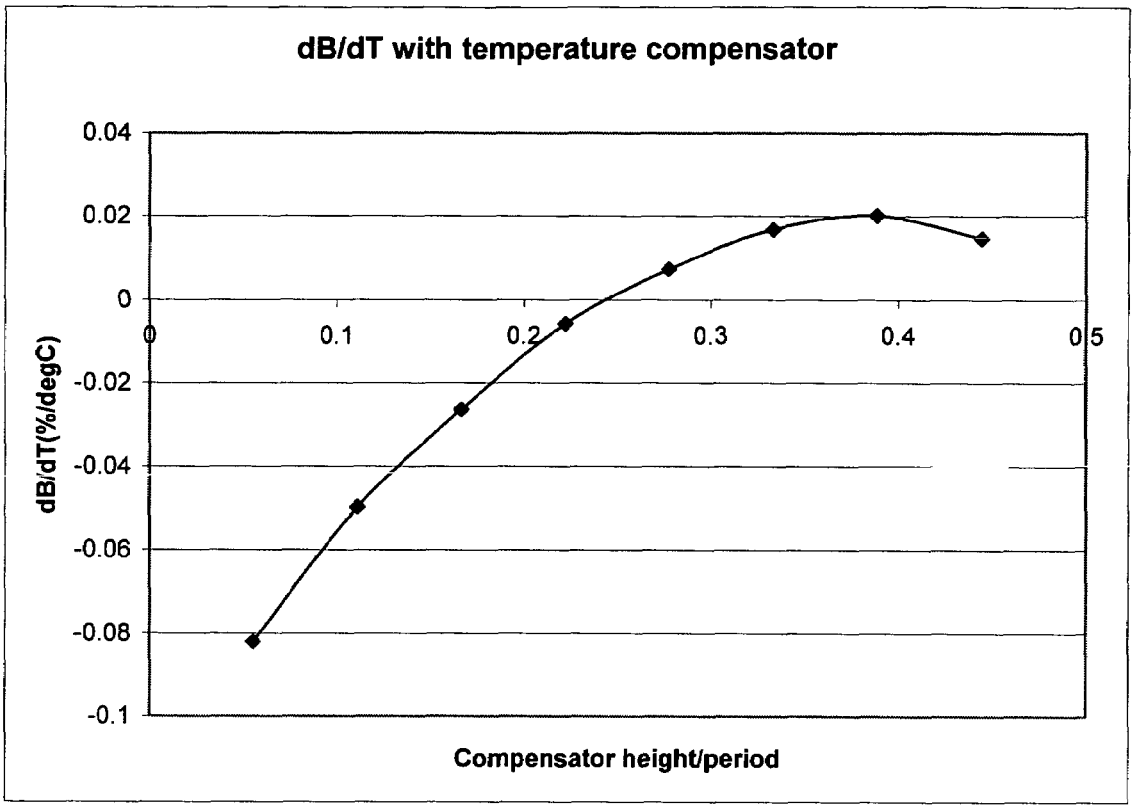
FIG. 4 is a graph showing dB/dT as a function of compensating material's height.

Referring to FIG. 3, the magnetic flux lines 17 of the half magnet 2*b* of FIG. 2 are shown. The flux lines 17*b* that are shunted through the compensating material 3*b* are also indicated. The temperature dependence of this design was analyzed. The magnets 2*b* in this example were Neodymium Iron Boron. Their strength varies at a rate of −0.1%/C.°. In the analysis, the vertical height (as shown in FIG. 3) of the compensating material 3*b* was varied, and dB/dT for different compensating material heights were determined. The results are shown in FIG. 4.

Figure 5:
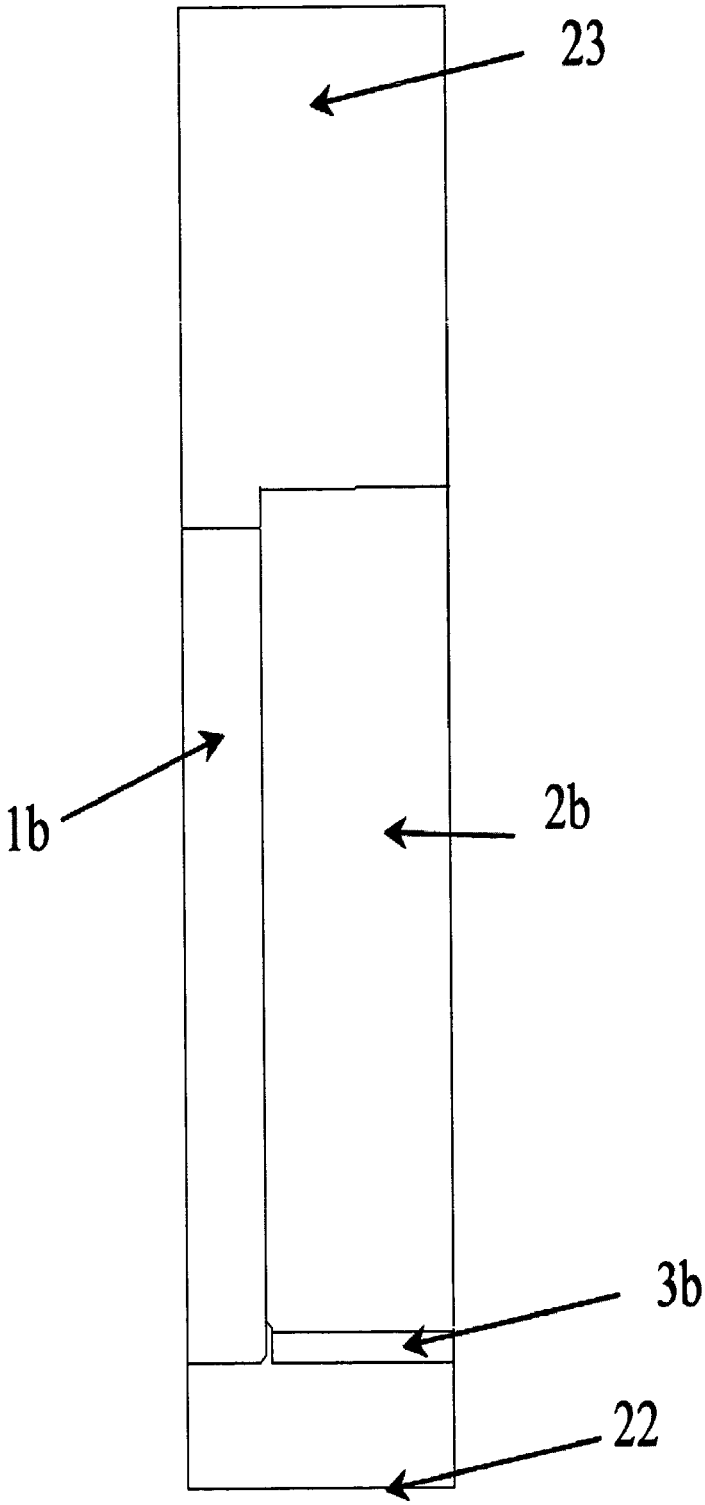
FIG. 5 illustrates an example in which temperature-compensating material is added to the front face of a magnet.
Figure 6:
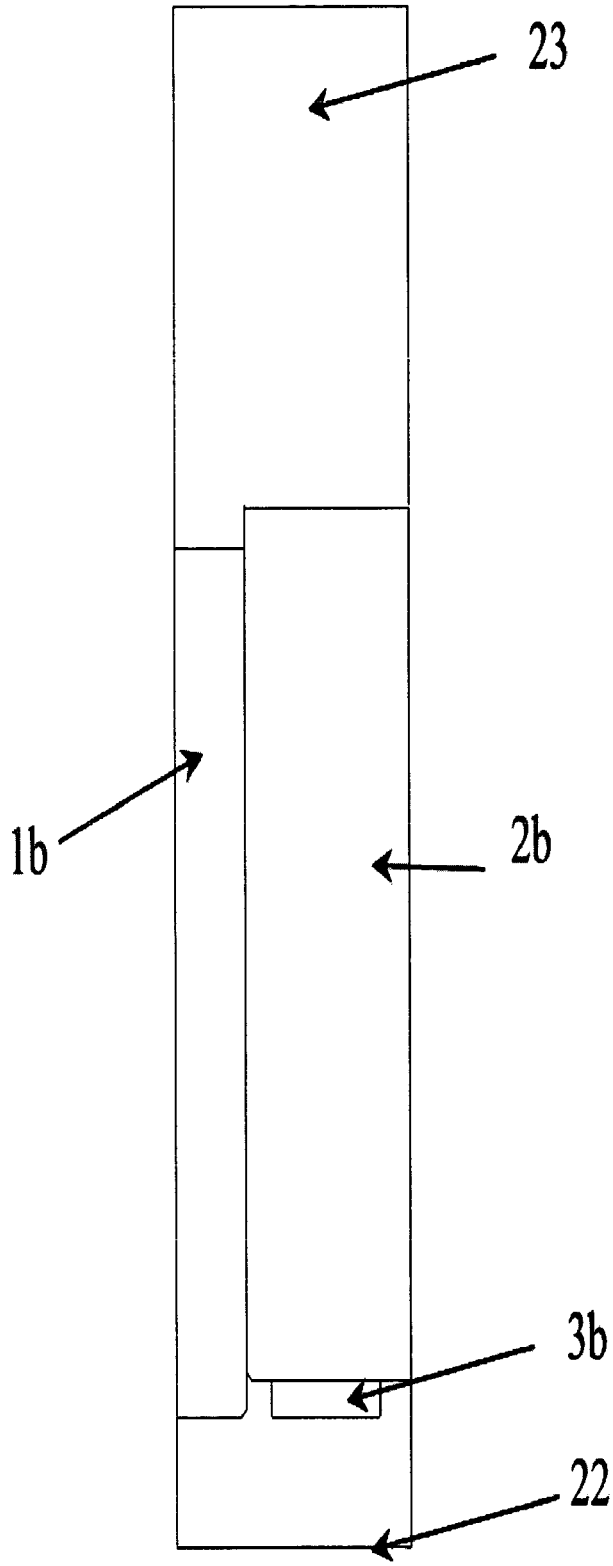
FIG. 6 illustrates an example in which temperature-compensating material is used to correct temperature-dependent field errors (i.e., temperature-independent shimming)

As can be seen, if the compensating material height is chosen to be about ¼ of an undulator period (i.e., the distance between one magnet to its adjacent magnet along the length of the undulatory, it removes the temperature dependence of the magnets. For large period undulators, this could be a large amount of compensating material. In such cases, it may be advantageous to put the compensating material on the "front" faces of the magnets facing the magnetic gap (or the mechanical centerline 22), instead. This arrangement is shown in FIG. 5, illustrating a half pole 1*b* and a half magnet 2*b*, as before, but including a half compensating material 3*b* placed on the front face of the magnet 2*b*.

This approach, however, may not be desirable in some applications for several reasons. The amount of compensating material needed to make dB/dT=0 is quite large. This makes shimming the magnetic field more difficult. Also, when a large amount of compensating material is used, the magnet must be recessed by the compensating material's height. This substantially reduces the magnetic field, which is in addition to the field reduction already caused by the compensating material. Also, any variations in the local magnetic fields produced by individual compensating materials will cause changes in the local magnetic field as seen by the electron beam passing through the magnetic gap. Therefore, when compensating materials are placed on the front magnet faces, they correct temperature dependence and field quality simultaneously. This makes tuning of the undulator more complex, although compensating materials have much smaller effect on the local magnetic field than standard steels. Typically, undulator tuning is done by using thin standard steel shims or even nickel shims only, to produce a weak tuning. In view of these issues, the most beneficial application of front compensating materials is one in which the field quality (or the field error) has a temperature dependence. Then, specially shaped front compensating materials, such as one shown in FIG. 6, could be used for temperature-dependent field tuning. The shape of the compensating material determines the local field errors that will be corrected. Thus, depending on the type of local field errors, other shapes could be used. In addition, the compensating material does not need to be centered on the magnet as in FIG. 6.

Figure 7:
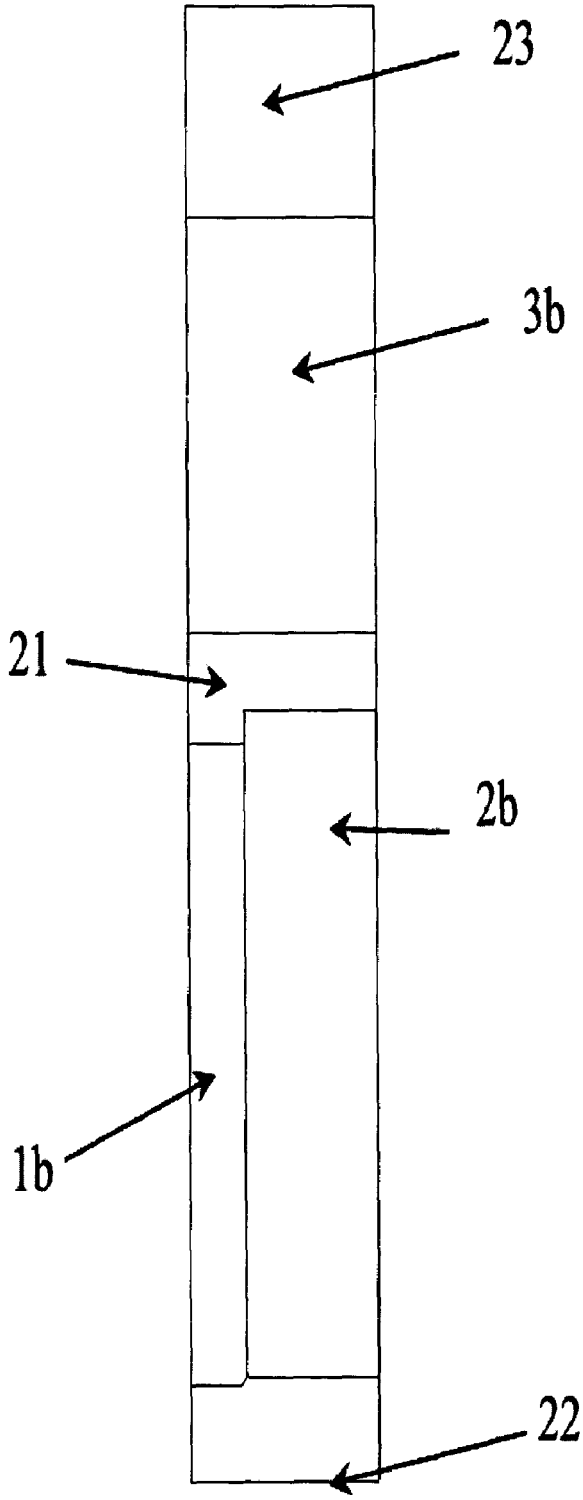
FIG. 7 illustrates an example in which temperature-compensating material is used with an air space between it and a magnet.

Referring now to FIG. 7, in another implementation, the temperature-compensating material 3*b* has an air space 21 between it and the undulator poles/magnets 1*b*, 2*b*. This air space 21 can be filled with any nonmagnetic material, such as aluminum or temperature independent standard steel. By adjusting the size of the air space 21, the dB/dT can be modified. With small air spaces, the compensating material shunts a large amount of flux. This may actually reverse the sign of dB/dT. As the air space 21 is increased, the compensating material shunts less flux, so dB/dT decreases. In essence, the compensating material acts like it is weaker. The use of an air space 21 has the advantage that the compensating material 3*b* could serve a dual purpose of being a mechanical component as well as a magnetic one. Also, since the compensating material's magnetic properties have variations, adjusting the air space 21 permits a simple way of adjusting (or compensating for) the effect of such variations.

The effect of the size of the air space 21 on dB/dT is shown in FIG. 8. Initially the compensating material is too thick, so dB/dT is positive. As the air space is increased, the compensating material becomes weaker until dB/dT=0 or any other desired value.

As will be apparent to one skilled in the art, it will always be possible to combine various compensating material configurations to meet a particular set of design requirements. For example, the air space 21 may be provided to correct the average dB/dT while some other techniques, to be described fully below, could be used on individual poles (or magnets) to correct for pole-by-pole (or magnet-by-magnet) variations.

These ideas can be extended to compensate for temperature-dependent centerline shifts. A particular example is shown in FIG. 9, including an upper half pole 1*b*, upper half magnet 2*b*, and a upper compensating material 3*b* coupled to the magnet 2*b*, and further including a lower half pole 1*c* and a lower half magnet 2*c*. In the FEA analysis, this example produced a positive magnetic centerline shift of 0.260 mm at 20 C.° and 0.197 mm at 30 C.°. These results are entirely consistent with the behavior predicted for a parallel compensating material 3*b* placed on the upper magnet 2*b*, as shown in FIG. 9. The centerline compensating material could also be placed on the back of the upper half pole 1*b*, or the front of the upper magnet 2*b* or the upper pole 1*b*, or may have an air space between it and the magnet 2*b* or the pole 1*b*, as shown in FIG. 7.

As was the case with field strength compensation, putting centerline compensating materials at the back of the magnets/poles should not affect the field quality, while putting them at the front of the magnets/poles will change the field quality. There could be a second order effect, in which shunting some flux away from the magnetic gap will affect the field quality when the poles are saturated. This can complicate the design and utilization of temperature-compensating steels.

Next, some three-dimensional embodiments of the present invention are described. In the following, the vertical direction denotes the strong field direction and the horizontal direction denotes the transverse field direction, while an axial direction denotes the direction of travel of the charged particle that passes through the center (i.e., magnetic gap) of the undulator. In a typical application, the vertical direction corresponds to the direction of gravity. However, there is no particular reason that the strong field direction must match the direction of gravity, and in some applications the main field may be in the horizontal direction instead.

Figure 11:
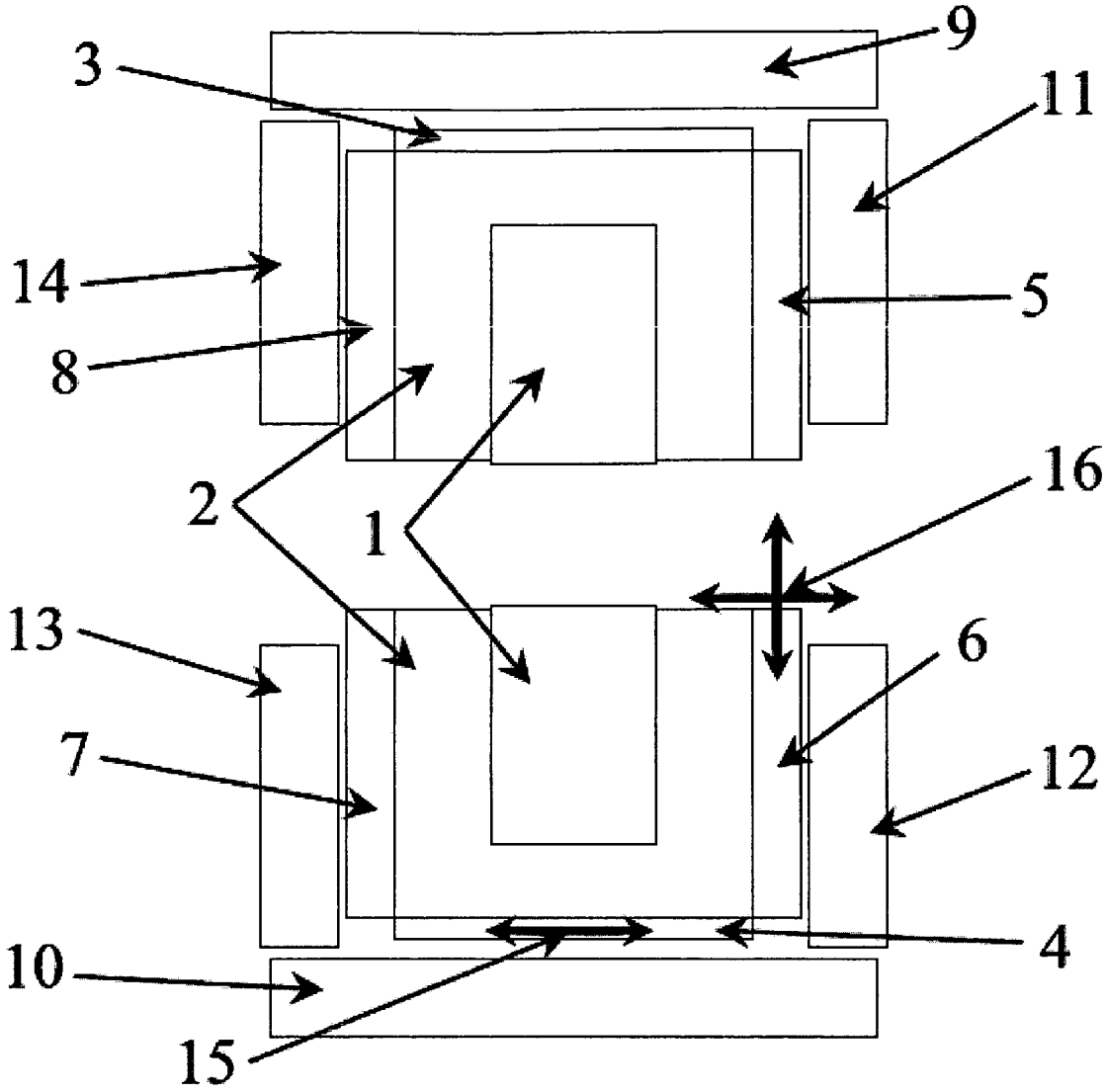
FIG. 11 is an end view of the undulator assembled from FIG. 10.
Figure 12:
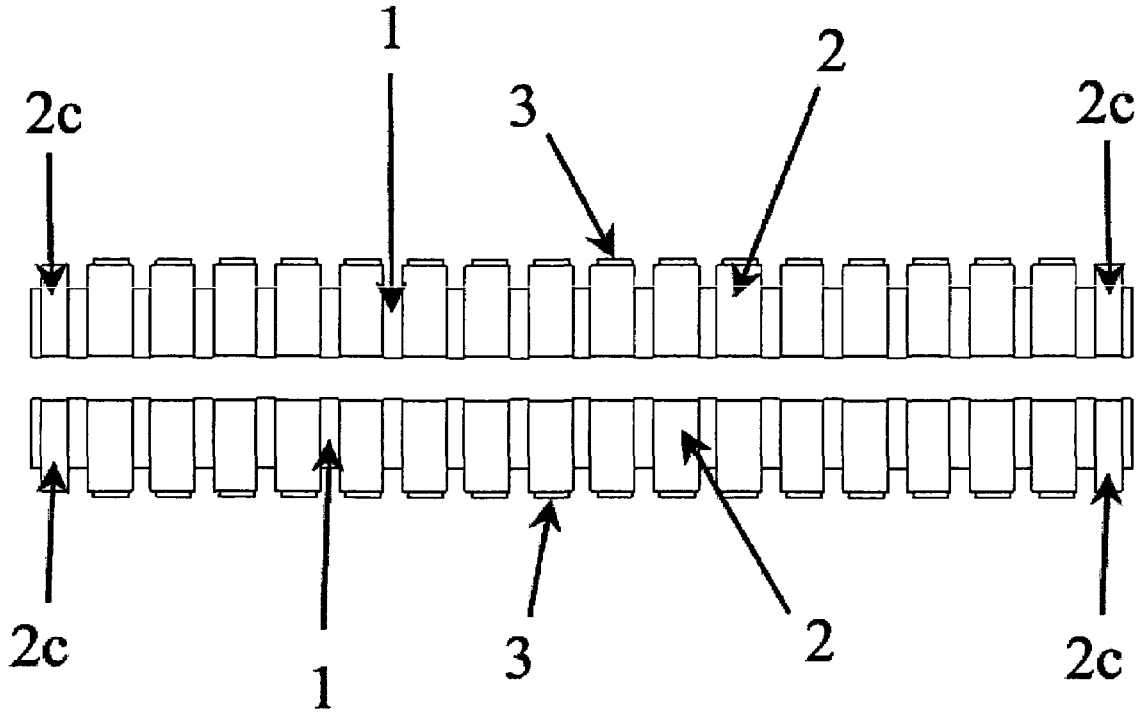
FIG. 12 is a side view of the opposing arrays of magnets and poles, as in FIG. 10, but with "side" compensators removed and including only "back" compensators.

Referring to FIGS. 10, 11, and 12, a linearly polarized undulator is shown, including opposing arrays of poles 1. The poles 1 may be of any ferromagnetic material (e.g., steel). For pure Rare Earth Permanent Magnet (REPM) undulators, the poles 1 may be vertically polarized magnets. The undulator further includes opposing arrays of main magnets 2, respectively coupled to the poles 1. For a linearly polarized undulator, the direction of magnetization of the magnets 2 is horizontal (i.e., alternately parallel and anti-parallel to the axial direction so as to create the alternating magnetic field of the undulator). Compensating materials 3 and 4 are placed on the "back" sides of the magnets 2, i.e., on the sides away from the mechanical centerline 22 extending through the magnetic gap defined by the arrays of magnets. Alternatively or additionally, "side" compensating materials 5, 6, 7, and 8 may be placed on the side surfaces of the magnets 2 to compensate for temperature-dependent field strength and/or magnetic centerline variations, as will be more fully described below.

As well known in the art, some undulators may further include side magnets arranged on the sides of poles. It should be apparent to those skilled in the art that the temperature-compensating material may be placed in association with the side magnets, in both series and parallel configurations, to achieve the desired temperature compensation effects.

The undulator further includes an upper support 9, a lower support 10, and side supports 11, 12, 13, and 14. These supports are collectively used for mechanical attachment and strengthening of the undulator comprising the poles 1 and magnets 2. The "back" compensating materials 3 and 4 may be attached to the upper and lower supports 9 and 10, respectively, while the "side" compensating materials 5, 6, 7, and 8 may be attached to the side supports 11, 12, 13, and 14, respectively.

The upper and lower supports 9 and 10 may be made of temperature-compensating material themselves, so as to achieve the dual function of support and compensation. Specifically, such supports 9 and 10 could perform the function of compensating for the field strength variation or for a centerline shift in the vertical direction. Likewise, the side supports 11, 12, 13, and 14 may also be made of temperature-compensating material to compensate for the field strength variation or for a centerline shift in the horizontal direction.

In many applications, the region between the magnets 2 and the upper and lower supports 9 and 10 cannot be used to hold temperature-compensating material at all. This restriction may be due to height restrictions, mechanical restrictions, or that the temperature-compensating material may need to be added to an existing undulator that is incapable of accommodating such material at these locations. Many undulators, however, do have space on the sides of the poles/magnets for receiving temperature-compensating material to correct for temperature-dependent strength variations or centerline shifts. For these undulators, the side compensating materials 5, 6, 7, and 8 can be readily added.

This approach is valid due to the detailed field distribution present in undulators. Those skilled in the art will appreciate that both a vertical overhang, represented by making the magnet 2 taller than the pole 1, and/or a horizontal overhang, represented by making the magnet 2 wider than the pole 1, are needed to make cost effective and efficient use of the pole and magnet material. These overhangs are used to reduce flux leakage in the horizontal and vertical regions. Nonetheless, there is always some leakage, and adding temperature-compensating material modifies the leakage. Accordingly, temperature-compensating steels could be used on the sides of the magnets 1 to compensate for the temperature dependence of the magnet strength. This is an extension of the use of the back compensating material (3, 4), which is shown to be effective in compensating for the magnetic field strength. In addition, it should be apparent to one skilled in the art that placing temperature-compensating steels on only one side of the magnets 1 (for example, 5 and 6 without 7 and 8) will be equivalent to placing temperature-compensating steels on only the upper or lower magnet. It should also be apparent to one skilled in the art that side compensating materials can be as effective in correcting field strength errors as placing compensating materials on the back or front sides of the magnets (and/or poles), though the side compensating materials can only compensate for a magnetic centerline shift in the horizontal direction.

It is noted that the use of side compensating materials requires twice as many pieces of temperature-compensating steel. For example, in order to compensate for the magnetic field strength, two compensating materials per upper and lower magnet, i.e., four compensating materials 5, 6, 7, and 8 as shown in FIG. 11, would be needed to achieve the same effect as only one compensating material per magnet if back compensating materials are used, i.e., two back compensating materials 3 and 4.

If the side compensating materials 5, 6, 7, and 8 are attached to the side supports 11, 12, 13, and 14, these is a simple and cost effective way to temperature compensate the undulator. Specifically, individual side compensating materials may be attached to the side supports with bolts, and the side compensating materials 5, 6, 7, and 8 may be moved radially in and out (i.e., toward and away from the mechanical axis). If all of the compensating materials are adjusted the same amount, the correction is essentially the same for all magnets to compensate for the average temperature dependence. However, there is a variation in the temperature dependence of individual magnets. In addition, mechanical movement of the different parts of the undulator will be different. By moving individual side compensating materials 5, 6, 7, and 8 (and/or the back compensating materials 3 and 4) for different amounts, a local correction of the field error can be achieved.

As discussed above, the upper and lower supports 9 and 10 and the side supports 11, 12, 13, and 14 could be made of temperature-compensating material to correct for the average temperature dependence of the magnets 2. This would probably be done during the design phase of the undulator. In one embodiment, it is contemplated that the back and side compensating materials 3, 4, 5, 6, 7, and 8 would be used (added, removed, their amounts adjusted, or their positions moved) during tuning. These compensating materials essentially function as local correctors. For example, referring specifically to FIG. 11, moving the back compensating materials 3 and 4 in any of the three orthogonal directions (only one is shown in arrow 15) will change the efficiency of the materials 3 and 4. The validity of this approach can be inferred from FIG. 3, wherein the flux lines 17 toward the back are more closely spaced in region 18 than in region 19. If the back compensating material **3*b* is moved from the less dense flux region 19 to the more dense region 18, the compensating material 3*b* will shunt more flux and therefore become more effective. Likewise, any of the side compensating materials 3, 4, 5, and 6 may be moved for tuning purposes in any of the three orthogonal directions (only two are shown in arrows 16**.) In one embodiment, it is contemplated that the temperature-compensating material is applied equally to each magnet (or pole), on its back, front, sides, etc. to achieve the average temperature compensation, and thereafter, the temperature-compensating material on each magnet (or pole) can be moved (or its amount being adjusted by adding or removing a small portion) to achieve fine tuning of the individual magnets.

This approach of moving the compensating materials, rather than changing the amount of material, can also be applied to the side supports 11, 12, 13, and 14 if they are made of temperature-compensating material. This would permit fine adjustment of the average compensation.

Figure 13:
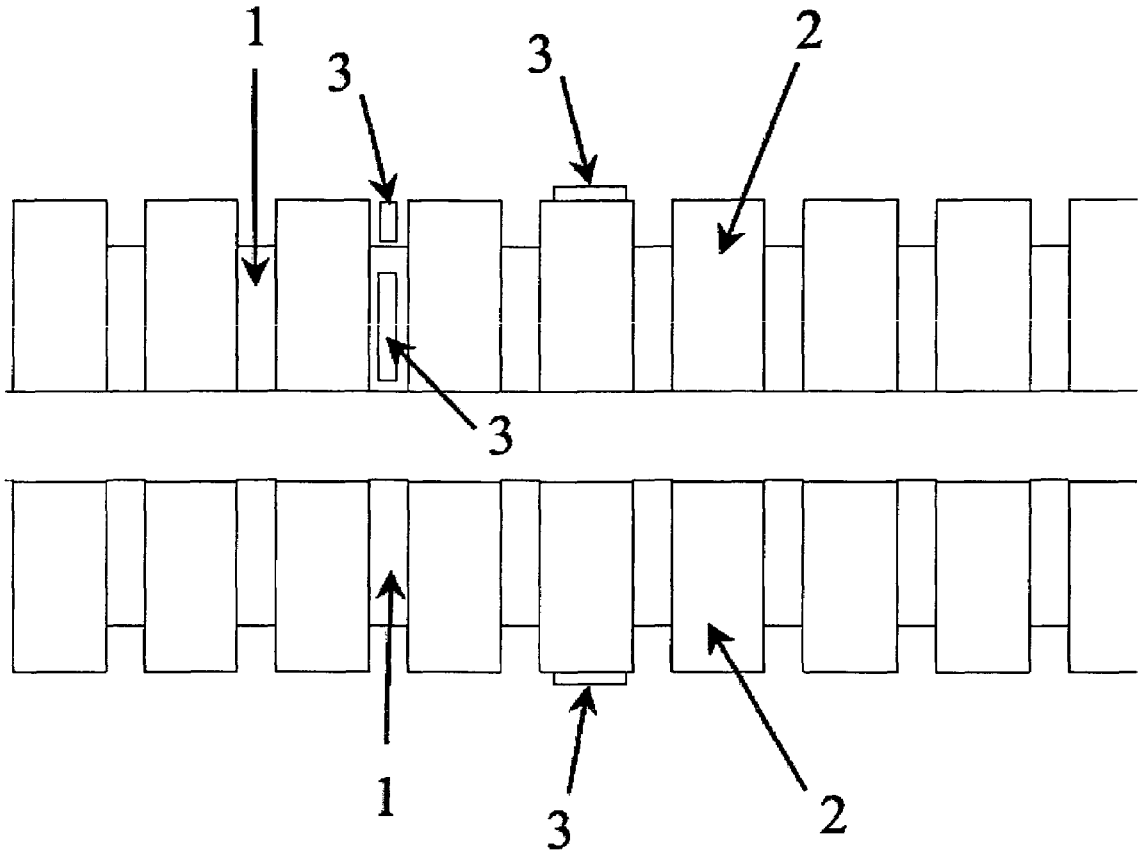
FIG. 13 is a side view of an undulator including opposing arrays of magnets and poles, wherein only one pair of magnets include "back" compensators to compensate for a local field strength variation due to temperature variations.
Figure 14:
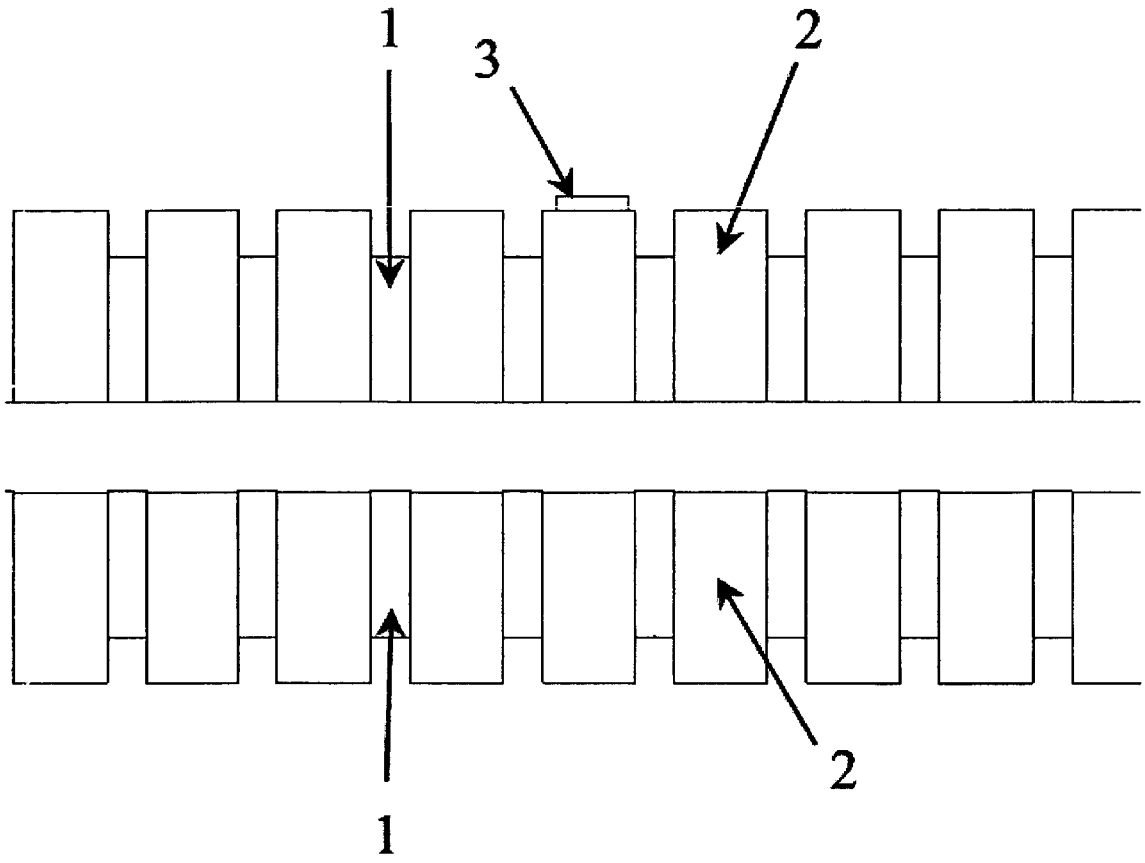
FIG. 14 is a side view of an undulator including opposing arrays of magnets and poles, wherein only one magnet (upper magnet) includes a "back" compensator to compensate for a local field centerline shift due to temperature variations.

By selectively applying temperature-compensating material to only a subset (e.g., one or two) of the magnets (or poles) in an array, the present method can achieve compensating for a local temperature-dependent field strength variation or centerline shift. FIG. 13 shows applying temperature-compensating material only on one pair of opposing magnets in the arrays of magnets. This approach is effective in adjusting the local temperature-dependent field strength characteristics. (FIG. 13 additionally shows possible positions of the temperature compensating materials 3, on the "back" and the "side" of a pole 1, as examples.) FIG. 14 shows applying temperature-compensating material to only one magnet in the opposing arrays of magnets. This approach is effective in achieving a local correction of a temperature-dependent magnetic centerline shift (in the vertical direction). The approaches shown in FIGS. 13 and 14 are useful in correcting for local temperature-dependent variations particularly when magnets (and poles) in an undulator have variations in their properties.

In one embodiment, the temperature-compensating materials can be used to make the temperature dependence of the magnetic field even stronger, to make a temperature-tunable undulator (i.e., an undulator whose field properties can be adjusted by changing the operating temperature). For example, by arranging a temperature-compensating material in a series flux shunting configuration, a temperature-dependent field change (or centerline shift) may be amplified. Two choices for placing a temperature-compensating material in a series flux shunting configuration to achieve this effect are shown in FIG. 3, at regions 20 and 21. Region 21 on the side of the pole 1*b* is in a direct flux path from the magnet 2*b* to the pole 1*b*. There will be some flux rearrangement, since the temperature-compensating material has a higher reluctance, but this can be analyzed or measured. The other location would be inside the pole 1*b*, as in region 20.

While the preferred embodiments of the invention have been illustrated and described above, it will be appreciated that various changes can be made therein without departing from the spirit and scope of the invention.

The invention claimed is:

1. An undulator comprising a periodic arrangement of magnets to produce a linearly symmetric periodic spatial magnetic field distribution in a magnetic gap defined by the magnets, further comprising a temperature-compensating steel selectively arranged to control the temperature dependence of the magnetic field.

2. The undulator of claim 1, wherein the magnets are supported by a support structure, and the temperature-compensating material is selectively arranged to decrease the temperature dependence of the magnetic field by compensating for a temperature-dependent change in the magnetic field.

3. The undulator of claim 2, wherein the temperature-compensating material is movably arranged to fine tune its compensation effect after it is initially arranged.

4. The undulator of claim 2, wherein the amount of temperature compensating material may be adjusted to fine tune its compensation effect after it is initially arranged.

5. The undulator of claim 2, wherein the temperature-compensating material is arranged to compensate for a temperature-dependent change in the strength of the magnetic field.

6. The undulator of claim 5, wherein the temperature-compensating material is arranged in a parallel flux shunting configuration to render the magnetic field strength independent of a temperature variation over a predefined range.

7. The undulator of claim 5, wherein the temperature-compensating material is arranged in a parallel plus series flux shunting configuration, and the contribution from the parallel shunting is stronger than the contribution from the series shunting so that the magnetic field strength is independent of a temperature variation over a predefined range.

8. The undulator of claim 5, wherein the temperature-compensating material is placed on the front surfaces of the magnets facing the magnetic gap.

9. The undulator of claim 5, wherein the temperature-compensating material is placed on the back surfaces of the magnets away from the magnetic gap.

10. The undulator of claim 5, further comprising poles arranged relative to the magnets, wherein the temperature-compensating material is associated with the poles.

11. The undulator of claim 10, wherein the temperature-compensating material is placed on the back surfaces of the poles away from the magnetic gap.

12. The undulator of claim 5, wherein the support structure comprises upper and lower structures for supporting upper and lower arrays of magnets, respectively, and equal amounts of temperature-compensating material are associated with the upper and lower structures, respectively.

13. The undulator of claim 2, wherein the temperature-compensating material is arranged to compensate for a temperature-dependent shift of the position of the magnetic field centerline.

14. The undulator of claim 13, wherein the temperature-compensating material is arranged in a parallel flux shunting configuration to render the position of the magnetic field centerline independent of a temperature variation over a predefined range.

15. The undulator of claim 13, wherein the temperature-compensating material is arranged in a parallel plus series flux shunting configuration, and the contribution from the parallel shunting is stronger than the contribution from the series shunting so that the position of the magnetic centerline is independent of a temperature variation over a predefined range.

16. The undulator of claim 13, wherein the magnets comprise a pair of opposing arrays of magnets, and different amounts of temperature-compensating material are associated with two opposing magnets, respectively.

17. The undulator of claim 13, wherein the support structure comprises upper and lower structures for supporting upper and lower arrays of magnets, respectively, and different amounts of temperature-compensating material are associated with the upper and lower structures, respectively.

18. The undulator of claim 2, wherein the temperature-compensating material is associated with end magnets that are placed on two ends of an array of the magnets.

19. The undulator of claim 18, wherein the temperature-compensating material is arranged to compensate for temperature-dependent steering of an electron beam passing through the undulator.

20. The undulator of claim 1, wherein the temperature-compensating material is selectively arranged to increase the temperature dependence of the magnetic field by rendering the magnetic field strongly dependent on a temperature variation over a predefined range.

21. The undulator of claim 20, wherein what is made strongly dependent on a temperature variation is the strength of the magnetic field.

22. The undulator of claim 20, wherein what is made strongly dependent on a temperature variation is the position of the magnetic field centerline.

23. The undulator of claim 20, wherein the temperature-compensating material is arranged in a series flux shunting configuration.

24. The undulator of claim 20, wherein the temperature-compensating material is in a parallel plus series flux shunting configuration, and the contribution from the series shunting is stronger than the contribution from the parallel shunting.

25. The undulator of claim 20, wherein the temperature-compensating material is placed on the side surfaces of the magnets with respect to the magnetic gap.

26. The undulator of claim 20, further comprising poles arranged relative to the magnets, wherein the temperature-compensating material is associated with the poles.

27. The undulator of claim 26, wherein the temperature-compensating material is placed on side surfaces of the poles with respect to the magnetic gap.

28. The undulator of claim 26, wherein the temperature-compensating material is placed between the magnet and the corresponding pole.

29. A method of correcting for a temperature-dependent change in an undulator, the undulator comprising a periodic arrangement of magnets to produce a linearly symmetric periodic spatial magnetic field distribution in a magnetic gap defined by the magnets, the magnets being supported by a support structure, the method comprising the step of selectively arranging temperature-compensating steel in the undulator to compensate for a temperature-dependent change in the magnetic field.

30. The method of claim 29, further comprising the step of moving the temperature-compensating material to fine tune its compensation effect after it is initially arranged in the undulator.

31. The method of claim 29, further comprising the step of varying the amount of the temperature-compensating material to fine tune its compensation effect after it is initially arranged in the undulator.

32. The method of claim 29, wherein the temperature-dependent change comprises a change in the strength of the magnetic field.

33. The method of claim 29, wherein the temperature-dependent change comprises a change in the position of the magnetic field centerline.

34. The method of claim 29, wherein the temperature-compensating material is applied to be associated with only a subset of the magnets, the subset comprising one or more magnets less than the whole magnets, to produce a local temperature-dependent variation to compensate for a local temperature-dependent change in the magnetic field.

35. The method of claim 29, wherein the temperature-compensating material in specifically shaped so as to additionally achieve the shimming effect of tuning the magnetic field to correct for temperature-dependent field errors.

* * * * *